US007070142B2

(12) United States Patent
Schnurr

(10) Patent No.: US 7,070,142 B2
(45) Date of Patent: Jul. 4, 2006

(54) CLAMPING DEVICE AND METHOD

(75) Inventor: Carl Schnurr, Everett (CA)

(73) Assignee: Honda Canada, Inc. (CA)

( * ) Notice: Subject to any disclaimer, the term of this patent is extended or adjusted under 35 U.S.C. 154(b) by 0 days.

(21) Appl. No.: 10/629,901

(22) Filed: Jul. 30, 2003

(65) Prior Publication Data

US 2004/0118966 A1 Jun. 24, 2004

Related U.S. Application Data

(60) Provisional application No. 60/399,400, filed on Jul. 31, 2002.

(51) Int. Cl.
*B65H 19/29* (2006.01)
*B65H 75/28* (2006.01)

(52) U.S. Cl. ..... 242/580; 242/581; 206/53

(58) Field of Classification Search ..... 242/580, 242/581, 125.2; 206/350, 53, 54, 55, 389, 206/818; 248/206.5, 309.4; 335/285
See application file for complete search history.

(56) References Cited

U.S. PATENT DOCUMENTS

| | | | | | |
|---|---|---|---|---|---|
| 1,692,789 | A | | 11/1928 | Young | |
| 1,951,062 | A | | 3/1934 | Peet | |
| 2,152,897 | A | * | 4/1939 | Madore | 206/818 |
| 2,176,052 | A | * | 10/1939 | Beyer | 206/818 |
| 2,548,248 | A | | 4/1951 | Wiebe | |
| 2,693,192 | A | * | 11/1954 | James | 206/818 |
| 2,709,051 | A | | 5/1955 | Bunch | |
| 2,813,710 | A | * | 11/1957 | Angle | 248/206.5 |
| 2,925,962 | A | | 2/1960 | Hebeler | |
| 3,531,058 | A | * | 9/1970 | Birschkus | 242/580 |
| 3,642,122 | A | * | 2/1972 | Von Ende | 206/818 |
| 3,646,492 | A | * | 2/1972 | Westermann | 335/285 |
| 3,998,325 | A | * | 12/1976 | Kulka | 206/400 |
| 4,532,750 | A | * | 8/1985 | Meier | 242/580 |
| 4,971,278 | A | * | 11/1990 | Woods | 248/206.5 |
| 5,236,087 | A | * | 8/1993 | Morgan | 206/818 |
| 5,346,165 | A | | 9/1994 | Frean et al. | |
| 5,577,619 | A | | 11/1996 | Callahan | |
| 6,124,777 | A | * | 9/2000 | Snider | 335/285 |
| 6,302,363 | B1 | * | 10/2001 | Olson et al. | 248/206.5 |
| 6,491,271 | B1 | * | 12/2002 | Adams | 248/206.5 |

* cited by examiner

*Primary Examiner*—John M. Jillions
(74) *Attorney, Agent, or Firm*—Katten Muchin Rosenman LLP

(57) ABSTRACT

Disclosed herein is magnetic clamp device for clamping at least one first article to a ferromagnetic second article, comprising a housing, at least one magnet means located in the housing, handle means extending from the housing, the magnet means being of sufficient magnetic strength to form a couple between the magnet means and the second article with the first article there between, the handle means being of sufficient length to permit a user to install the device on an outer free end portion of a roll of sheet steel and to provide sufficient leverage to remove the device, the housing means including a pair of housing portions, each to extend along a corresponding peripheral region of the magnet element so as to substantially encircle the peripheral region of the magnet element.

10 Claims, 4 Drawing Sheets

CLAMPING DEVICE AND METHOD

REFERENCE TO CO-PENDING APPLICATIONS

The entire subject matter of U.S. Provisional application Ser. No. 60/399,400 filed Jul. 31, 2002 and entitled CLAMPING THE FREE END OF A ROLL OF SHEET STEEL is incorporated by reference. The applicant claims priority benefit under Title 35, United States Code, Section 119(e) of U.S. Provisional application Ser. No. 60/399,400 filed Jul. 31, 2002 and entitled CLAMPING THE FREE END OF A ROLL OF SHEET STEEL.

BACKGROUND OF THE INVENTION

1. Field of the Invention

The present invention relates to clamping devices, and more particularly but not necessarily exclusively, to devices and methods for clamping the free end of a roll of sheet steel, or other articles.

2. Description of the Related Art

It is common in some manufacturing operations, such as automobile manufacturing, to process large rolls of sheet steel in a stamping plant. When these rolls of sheet steel are manufactured, they are usually strapped by way of a number of steel straps to maintain the roll in a tight toroidal coil. These straps are applied about the toroidal axis and must be removed before the free end of the roll of sheet steel can be fed to the stamping plant. Sheet steel is relatively resilient and the free end will typically spring outwardly from the coil when the straps are removed. The free end usually is very sharp and, once freely extending off the coil, can present a potential for injury to workers in its vicinity. It would be desirable to clamp the free end to minimize this potential for injury.

It is therefore an object of the present invention to providing a novel clamping device.

SUMMARY OF THE INVENTION

In one of its aspects, the present invention involves a sheet steel roll assembly comprising a roll of sheet steel, the roll having an inner end region, a length of sheet steel wound around the inner end region to form a roll body having an outer surface, the roll having an outer free end region positioned adjacent a neighbouring region of the outer surface of the roll body and a magnetic force applicator coupled to the outer free end region and the roll body to maintain the outer free end region and the roll body in contact with one another.

In one embodiment, the magnetic force applicator further comprises a first portion to receive at least one magnet element and the first portion includes a housing to receive the magnet element therein. The magnetic force applicator further comprises a second portion which extends outwardly from the first portion. In this case, the second portion dimensioned to be gripped by a user to install the magnetic force applicator in position against the free end region. The housing has an open end through which the magnet element extends, so as to make direct contact with the free end region.

Preferably, the housing is at least four sided, though the housing may be other shapes such as circular, provided they are suitable to retain the one or magnets therein. For example, the housing could also be three sided (as in triangular) or be cylindrical.

The housing preferably further comprises a retainer portion for retaining the magnet element in the housing portion.

In this case, the housing has a side wall and the retainer portion includes a threaded member which is threadably engaged with the side wall.

The magnetic force applicator in one preferred embodiment, comprises one or more magnetic elements capable of delivering a magnetic coupling force of sufficient strength to clamp the outer free end region of the roll of sheet steel.

The one or more magnetic elements may be, for example, rare earth magnets which are known for their significantly higher magnetic strength over other more conventional magnets, though the latter may also be suitable in some applications. Other magnetic elements may also be used such as an electromagnet whose magnetic strength is derived by an external or internal source of electricity or both (such as by an electrical cord in the former instance of battery in the latter instance, for example.)

One or more such magnetic force applicators may be employed if the force delivery by one of the applicators is not sufficient to clamp the majority of the outer free end region against the roll body. For example, two or more such applicators may be positioned side by side on the outer free end region.

In another of its aspects, the present invention provides a magnetic clamp device for clamping a free end region of a roll of sheet steel against the roll of sheet steel, comprising a housing portion, at least one magnet element located in the housing portion, a handle portion extending from the housing portion, the magnet element being of sufficient magnetic strength to couple with both the outer free end region and the roll of sheet steel to draw the outer free end region and the roll of sheet steel into contact with one another, the handle portion being of sufficient length to permit a user to install the device on the outer free end region and to provide sufficient leverage to remove the magnetic clamp device therefrom.

In still another of its aspects, the present invention provides a method for clamping the free end of a roll of sheet steel, comprising the steps of:

providing a roll of sheet steel, the roll having an inner end region, a length of sheet steel wound around the inner end region to form a roll body having an outer surface, the roll having an outer free end region positioned adjacent a neighbouring region of the outer surface of the roll body;

selecting one or magnets which are of sufficient magnetic strength to couple with both the outer free end region of the roll of sheet steel and the roll body to draw the outer free end region and the roll body into contact with one another solely by the magnetic strength of the selected one or more magnets; and coupling the selected one or more magnets with both the outer free end region of the roll of sheet steel and the roll body so that the outer free end region and the roll body are in contact with one another.

Preferably, the method further comprises the step of installing the one or more magnets in a first portion of a magnetic applicator.

Preferably, the method further comprises the step of providing the magnetic applicator with a second portion which extends outwardly from the first portion and is dimensioned to be gripped by a user to install the magnetic applicator in position against the outer free end region.

Preferably, the method further comprises the step of providing the first portion with a housing to contain the one or more magnets and which has an open end through which the one or more magnets extend to make direct contact with the outer free end region.

Preferably, the method further comprises the step of providing the housing with a retainer portion for retaining the one or more magnets in place. Preferably, the retainer portion is provided by a threaded member which is threadably engaged with a side wall of the housing.

In another of its aspects, the present invention provides a magnetic clamp device for clamping an outer free end region of a roll of ferromagnetic material against the roll of ferromagnetic material, comprising a housing portion, at least one magnet element located in the housing portion, a handle portion extending from the housing portion, the magnet element being of sufficient magnetic strength to couple with both the outer free end region and the roll of ferromagnetic material to draw the outer free end region and the roll into contact with one another, the handle portion being of sufficient length to permit a user to install the device on an outer free end portion and to remove the device therefrom, wherein the magnet element has a peripheral region, the first housing including at least one housing portion to extend along the peripheral region of the magnet element.

In one embodiment, the housing further comprising a pair of housing portions, each to extend along a corresponding peripheral region of the magnet element so as to substantially encircle the peripheral region. Each housing portion including a pair of ends, each end having a mounting flange to align with an adjacent mounting flange on the other housing portion, so that the mounting flanges may be secured to one another to fix the housing portions to the magnet element. Each of the mounting flanges includes a passage to receive a fastener there through. Each housing portion has a width that exceeds a corresponding dimension of the magnet. A lining portion extends between the magnet element and the housing portions. In this case, the lining portion is resilient and stretched over the peripheral region of the magnet.

In another of its aspects, there is provided a magnetic clamp device for clamping an outer free end of a roll of ferromagnetic material against the roll, comprising a housing means, magnetic force generating means located in the housing means, handle means extending from the housing means, the magnetic force generating means being of sufficient magnetic strength to couple with both the outer free end region and the roll to draw the outer free end region and the roll into contact with one another, the handle means being of sufficient length to permit a user to install the device on the outer free end portion and to remove the device therefrom.

In one embodiment, the magnetic force generating means includes at least one magnet element, the magnet element having a peripheral region, the housing means including at least one housing portion to extend along the peripheral region of the magnet element.

In still another of its aspects, there is provided a magnetic clamp device for clamping at least one first article to a ferromagnetic second article, comprising housing means, at least one magnet means located in the housing means, handle means extending from the housing means, the magnet means being of sufficient magnetic strength to hold the first article between the magnetic clamp device and the second article, the handle means being of sufficient length to permit a user to install and to remove the device, the housing means including a pair of housing portions, each to extend along a corresponding peripheral region of the magnet element so as to substantially encircle the peripheral region of the magnet element, each housing portion including a pair of ends, each end having a mounting flange to align with an adjacent mounting flange on the other housing portion, so that the mounting flanges may be secured to one another to fix the housing portion to the magnet element.

In one embodiment, each of the mounting flanges includes a passage to receive a fastener there through. Each housing portion has a width that exceeds a corresponding dimension of the magnet means. A lining portion extends between the magnet means and the housing portions. In this case, the lining portion is resilient and stretched over the peripheral region of the magnet means.

BRIEF DESCRIPTION OF THE DRAWINGS

Several preferred embodiments of the present invention will now be described, by way of example only, with reference to the appended drawings in which.

DESCRIPTION OF THE PREFERRED EMBODIMENTS

Figure 1:
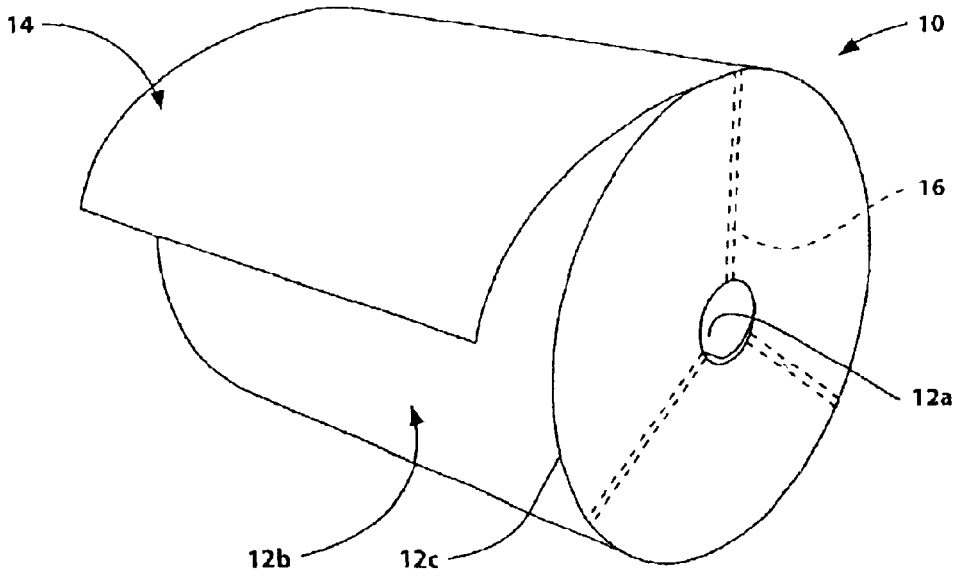
FIG. 1 is a perspective view of a roll of sheet steel with its free end in a released position.

FIG. 1 illustrates, at 10, a roll of ferromagnetic material, in this case sheet steel, in a released position. The roll 10 has an inner end region 12*a*, a length of sheet steel wound around the inner end region 12*a* to form a roll body 12*b* having an outer surface 12*c*. The roll also has an outer free end region 14 which is positioned adjacent a neighbouring region of the outer surface of the roll body and is shown in FIG. 1 in a released position. The term 'released position' refers to the fact that the straps, normally used to secure the roll for shipping (and shown in dashed lines at 16 and wrapped toroidally around the roll), have been removed and the outer free end region 14 is extending outwardly from the outer surface 12*c*.

Figure 2:
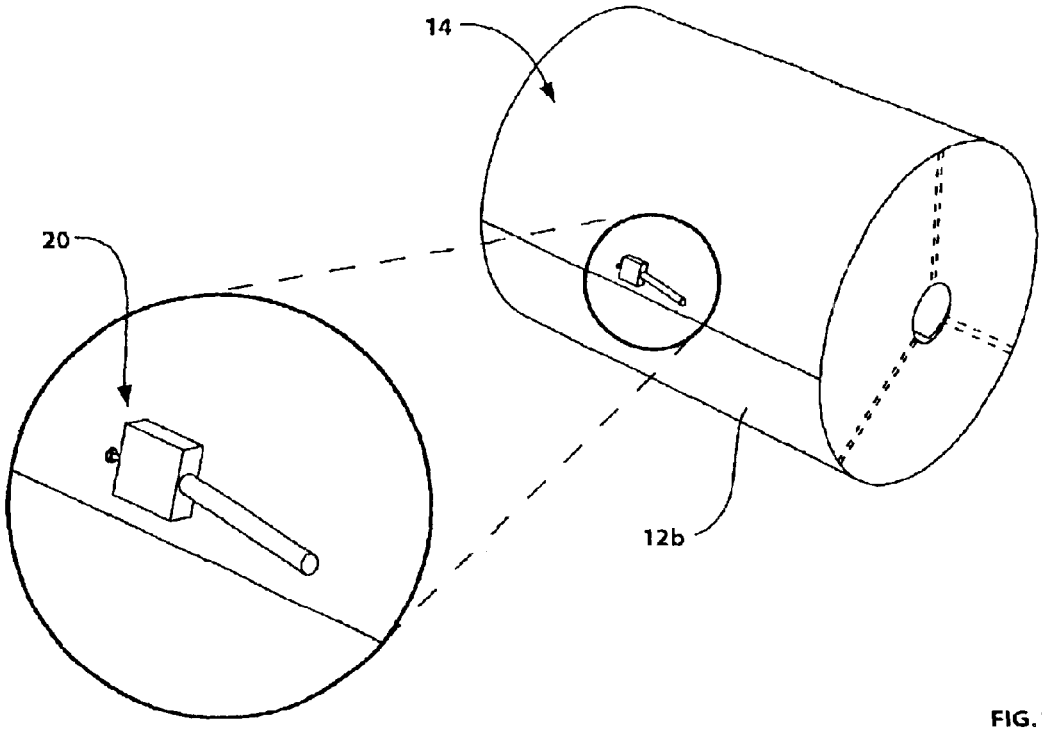
FIG. 2 is a perspective view of a roll of sheet steel with its free end in a clamped position.
Figure 3:
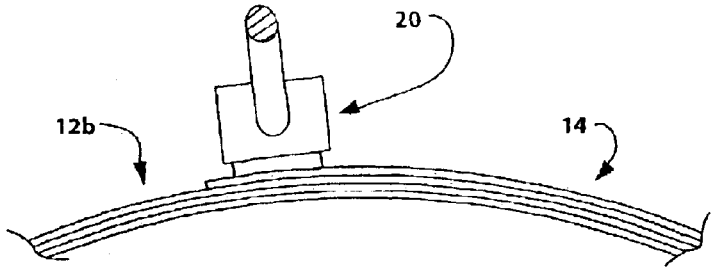
FIG. 3 is a magnified fragmentary side view of the roll of FIG. 2.

FIGS. 2 and 3 illustrate the roll of sheet steel 10, but in this case a magnetic force applicator 20 is coupled to the outer free end region 14 and the roll body 12*b* to maintain the outer free end region and the roll body in contact with one another.

Figure 4:
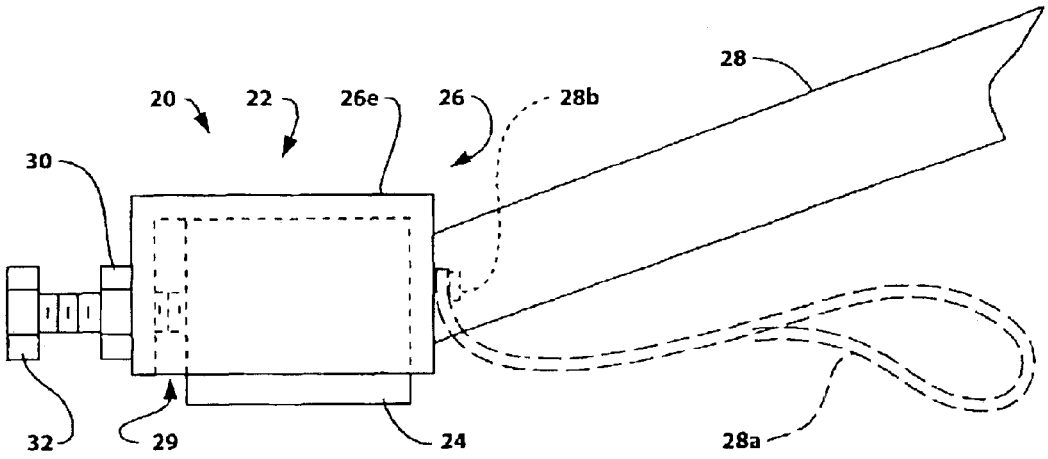
FIG. 4 is a side view of a magnetic clamp device.
Figure 5:
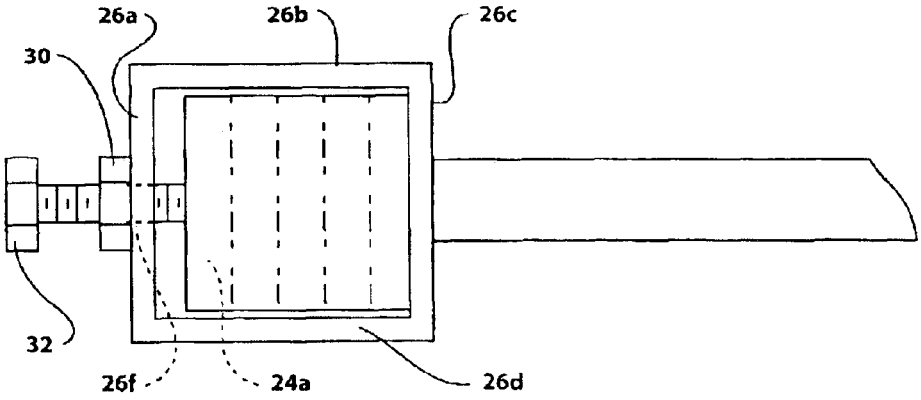
FIG. 5 is a bottom plan view of the device of FIG. 4.

Referring to FIGS. 4 and 5, the magnetic force applicator 20 further comprises a first portion 22 to receive at least one magnet element 24 and the first portion includes a housing 26 to receive the magnet element therein. The magnetic force applicator 20 further comprises a second portion 28 which extends outwardly from the first portion. In this case, the second portion is arranged to serve as a handle. In other words, the second portion is dimensioned to be gripped by a user to install the magnetic force applicator in position against the free end region. The handle 28 could be replaced by another member or portion such as handle of a different shape and may be either relatively rigid or flexible, the latter of course including such things as chains, cords or straps, as shown for example in dashed lines at 28*a*, which is fastened to the housing 26 by fastener shown in dashed lines at 28*b*.

It can be seen in FIGS. 4 and 5 that the housing 26 has an open end 29 through which the magnet element 24 extends, so as to make direct contact with the outer free end region. In this case, the housing has four side walls 26*a–d* and a top wall 26*e*. Welded to the side wall 26*a* is a threaded nut 30 which is positioned in line with a passage 26*f* extending through the side wall 26*a*. A retainer member, in the form of a threaded bolt 32, extends through the nut 30.

In this case, the bolt 32 restrains a single magnet element 24 in the housing by holding the magnet element 24 against the side wall 26*c*. As can be seen by the dashed lines in FIG. 5, the single magnet may be replaced by, among others, a number of individual magnet elements, shown at 24*a*. Other means may be employed to secure the magnet element 24 in the housing 26 such as by the use of clamps, adhesives layers, adhesive tapes and the like.

In one example, a rare earth magnet having the approximate dimensions of 2 inches by 2 inches by 1 inch has been found to provide sufficient strength to hold the free end region against the roll body. While the figures illustrate the free end being held uniformly tightly against the roll body, particularly in FIG. 3, it will be understood that such tight and uniform engagement is not likely to occur in practice, but rather will depend on the number of factors such as the condition of both the free end region and the roll body, and the presence of any folds, bends or the like on the free end region. Nonetheless, the clamped free end region should provide an improved sheet steel roll assembly.

Figure 6:
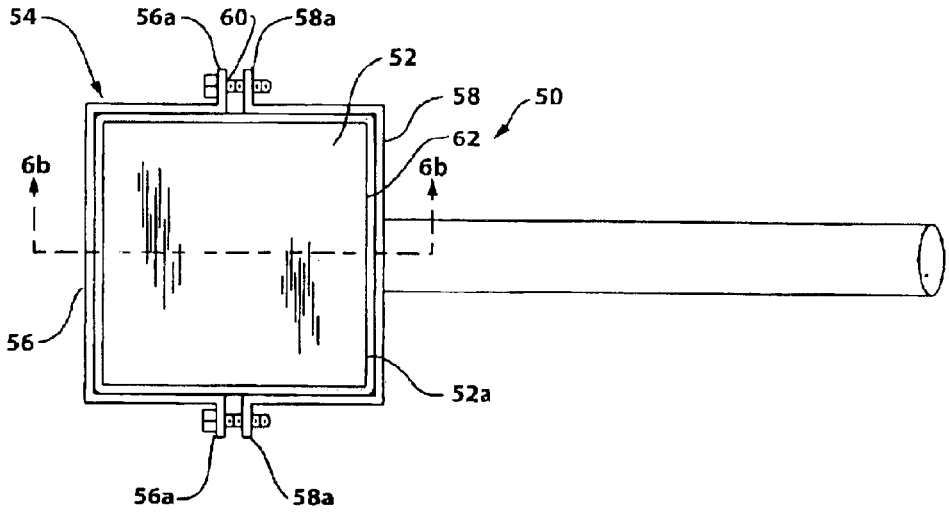
FIG. 6 is a plan view of another magnetic clamp device.
Figure 7:
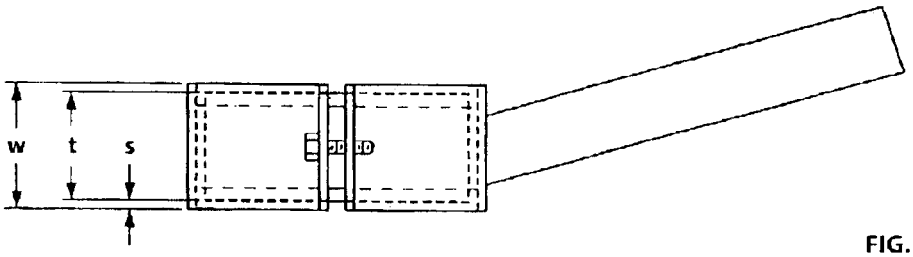
FIG. 7 is a side view of the device of FIG. 6
Figure 8:
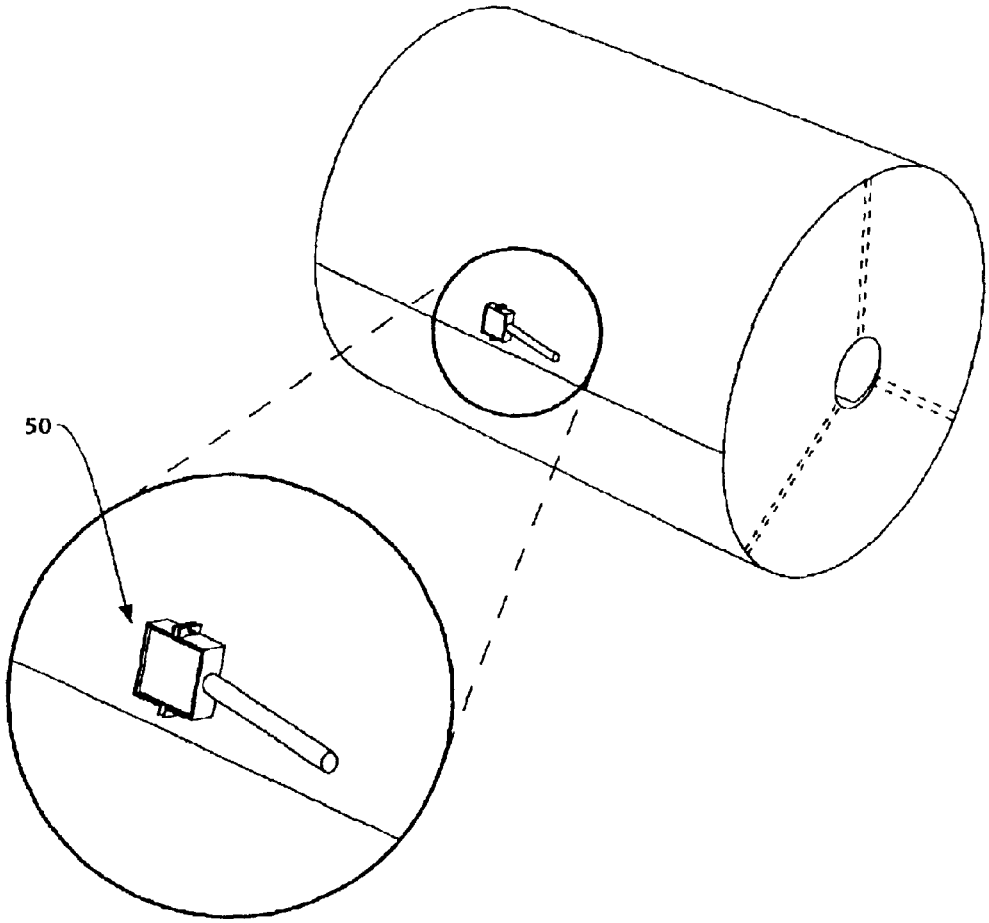
FIG. 8 is a magnified fragmentary perspective view of a roll of sheet steel with its free end in a clamped position.

Another device is shown at 50 in FIGS. 6 through 8, containing a magnet element 52. In this case, the magnet element 52 has a peripheral region 52*a*. A housing is provided at 54 with a pair of housing positions 56, 58 to extend along the peripheral region of the magnet element 52 so as to substantially encircle the peripheral region 52*a* of the magnet element 52. The housing portions includes a pair of adjacent mounting flange pairs 56*a*, 58*a*. Each of the mounting flanges includes a passage to receive a fastener 60 there through to draw the housing portions together and thereby tighten the housing 56 on the magnet 52.

The fasteners may be removable threaded fasteners, such as screws or bolts, or alternatively be non removable fasteners such as rivets and the like, or be replaced by spot welds, adhesives or the like or by a clamp or buckle arrangement. The housing may also be a one piece strap portion to encircle the peripheral region 52*a* of the magnet element 52 with opposite ends attachable in the manner described. The housing may be formed of metals such as steel plate or steel strap, or aluminum, plastics, fiberglass or the like and many also include such things as nylon or polypropylene webbing or the like.

As can be seen in FIG. 7, each housing portion 56, 58 has a width 'w' that exceeds the thickness 't' of the magnet, so that the magnet is partially shrouded by the housing so as not to be in direct contact with the roll of sheet steel surface in use. In other words, the housing provides a small spacing, shown at "s" in FIG. 7 between the magnet and the surface on which the clamp device is placed (as shown in FIG. 8). The spacing may, in one case be in the order of a few millimeters and may be influenced, in part, by the strength of the magnet. If desired, the magnet may be positioned in the housing so that there is no spacing, in some cases.

Figure 6A:
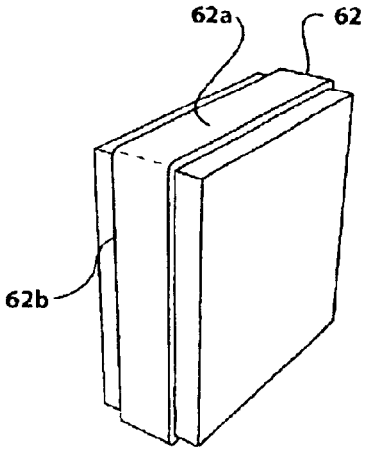
FIG. 6*a* is a perspective view of a portion of the device of FIG. 6.

Referring to FIG. 6*a*, a resilient lining portion 62 extends between the magnet element and the housing portions. The lining portion is resilient and is, in this example, an elastic band which is stretched over the peripheral region of the magnet. The lining may be in some other form such as a plurality of discrete lining portions 62*a*, 62*b* bonded to a corresponding surface on the magnet element or the housing. It may, for instance, be bonded to the magnet, the housing or both.

Figure 6B:
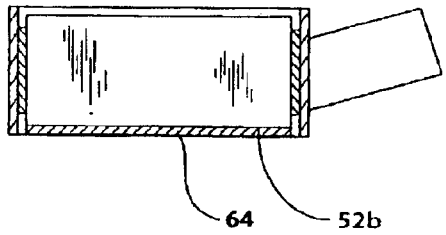
FIG. 6*b* is a sectional view taken on line 6*b*–6*b* of FIG. 6.

Referring to FIG. 6*b*, the magnet may also be shielded in other ways, such as by the use of a protective resilient or non-resilient layer of material as shown at 64 on the lower surface of the magnet shown at 52*b*. This protective layer may also be provided on other surfaces as desired and may be applied using a number of different methods such as bonding the resilient layer directly to the applicable surface, or by dipping or immersing the magnet in a curable material in a powdered, liquid state, or a slurry, for example.

The magnetic force applicator 20 may be used as follows. The roll of sheet steel is positioned as shown in FIG. 1 with its free end region extending outwardly from the roll body. The magnetic force applicator may then be oriented so that the exposed end of the magnet element is adjacent the free end region and in a central region thereof. The applicator 20 may then be brought into contact with the free end region. If desired, the free end region may be held in its desired position against the roll body prior to contact with the applicator 20. When the roll of sheet steel is to be used, the applicator may then be removed by gripping and drawing the handle, and hence the applicator, away from the roll body, thus releasing the free end region.

While the present invention has been described for what are presently considered the preferred embodiments, the invention is not so limited. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

While the devices shown herein are particularly suited to the clamping of the free end of a roll of steel, they may also be used to clamp other arrangements, packages, bundles or assemblies of steel or other ferromagnetic arrangements such as steel plate, one or more unitary ferromagnetic structures such as boxes, and the like. The devices may also be used to secure, for instance, other materials to such arrangements. For example, the devices may be used to hold protective tarps or labels or the like on such arrangements. The ferromagnetic materials may include various ions and steels and alloys thereof. The ferromagnetic material may also include plastics, and other non-ferromagnetic metals which have a ferromagnetic component either bonded to or distributed therein. There may be cases where the housing 54 may not encircle substantially the entire peripheral region of the of the magnet element but rather a sufficient portion thereof to make a firm coupling therewith, which may be enhanced by the strength of the magnet if the housing includes a ferromagnetic material. The substantial encircling of the magnet element by the housing is beneficial for protecting the magnet element against damage during use.

What is claimed is:

1. A magnetic clamp device for clamping an outer free end region of a roll of ferromagnetic material against the roll of ferromagnetic material, comprising:

a housing portion;

at least one magnet element located in the housing portion; and a handle portion extending from the housing portion, the magnet element being of sufficient magnetic strength to couple with both the outer free end region and the roll of ferromagnetic material to draw the outer free end region and the roll into contact with one another, the handle portion being of sufficient length to permit a user to install the device on an outer free end portion and to remove the device therefrom, wherein the magnet element has a peripheral region, the first housing including at least one housing portion to extend along the peripheral region of the magnet element, the housing further comprising a pair of housing portions, each to extend along a corresponding peripheral region of the magnet element so as to substantially encircle the peripheral region, each housing portion including a pair of ends, each end having a mounting flange to align with an adjacent mounting flange on the other housing portion, so that the mounting flanges may be secured to one another to fix the housing portions to the magnet element.

2. A device as defined in claim 1 wherein each of the mounting flanges includes a passage to receive a fastener there through.

3. A device as defined in claim 2 wherein each housing portion has a width that exceeds a corresponding dimension of the magnet.

4. A device as defined in claim 3, further comprising a lining portion to extend between the magnet element and the housing portions.

5. A device as defined in claim 4 wherein the lining portion is resilient and stretched over the peripheral region of the magnet.

6. A magnetic clamp device for clamping at least one first article to a ferromagnetic second article, comprising:

housing means;

at least one magnet means located in the housing means; and handle means extending from the housing means, the magnet means being of sufficient magnetic strength to hold the first article between the magnetic clamp device and the second article, the handle means being of sufficient length to permit a user to install and to remove the device, the housing means including a pair of housing portions, each to extend along a corresponding peripheral region of the magnet element so as to substantially encircle the peripheral region of the magnet element, each housing portion including a pair of ends, each end having a mounting flange to align with an adjacent mounting flange on the other housing portion, so that the mounting flanges may be secured to one another to fix the housing portions to the magnet element.

7. A device as defined in claim 6 wherein each of the mounting flanges includes a passage to receive a fastener there through.

8. A device as defined in claim 7 wherein each housing portion has a width that exceeds a corresponding dimension of the magnet means.

9. A device as defined in claim 8, further comprising a lining portion to extend between the magnet means and the housing portions.

10. A device as defined in claim 9 wherein the lining portion is resilient and stretched over the peripheral region of the magnet means.

* * * * *

UNITED STATES PATENT AND TRADEMARK OFFICE

CERTIFICATE OF CORRECTION

PATENT NO. : 7,070,142 B2
APPLICATION NO. : 10/629901
DATED : July 4, 2006
INVENTOR(S) : Carl Schnurr It is certified that error appears in the above-identified patent and that said Letters Patent is hereby corrected as shown below:

Column 6, line 59: “housing portion” should read --housing--.

Column 6, line 60: “housing portion” should read --housing--.

Column 6, line 62: “housing portion” should read --housing--.

Column 7, line 2: “wherein the magnet element has a peripheral region, the first housing including at least one housing portion to extend along the peripheral region of the magnet element, the housing further comprising a pair of housing portions,” should read --wherein the magnet element has a peripheral region, the housing further comprising a pair of housing portions--.

Signed and Sealed this

Twenty-eighth Day of October, 2008

JON W. DUDAS
*Director of the United States Patent and Trademark Office*